United States Patent [19]

Katagiri et al.

[11] Patent Number: 4,481,273

[45] Date of Patent: Nov. 6, 1984

[54] ELECTROPHOTOGRAPHIC PHOTOSENSITIVE MEMBER AND PREPARATION THEREOF

[75] Inventors: Kazuharu Katagiri; Yoshihiro Oguchi, both of Yokohama; Yoshio Takasu, Tama, all of Japan

[73] Assignee: Canon Kabushiki Kaisha, Tokyo, Japan

[21] Appl. No.: 496,430

[22] Filed: May 20, 1983

[30] Foreign Application Priority Data

May 27, 1982 [JP] Japan ..... 57-90268

[51] Int. Cl.[3] ..... G03G 5/04

[52] U.S. Cl. ..... 430/59; 430/58; 430/69; 430/127; 430/132; 430/133; 430/134

[58] Field of Search ..... 430/69, 127, 132, 133, 430/134, 58, 59

[56] References Cited

U.S. PATENT DOCUMENTS

| | | | |
|---|---|---|---|
| 2,599,542 | 6/1952 | Carlson | 430/69 |
| 2,863,768 | 12/1958 | Schaffert | 430/69 X |
| 3,849,128 | 11/1974 | Inara | 430/133 X |
| 3,888,665 | 6/1975 | Wiedemann | 430/69 X |

FOREIGN PATENT DOCUMENTS

| | | | |
|---|---|---|---|
| 51-4110 | 2/1976 | Japan | 430/133 |

*Primary Examiner*—Roland E. Martin

*Attorney, Agent, or Firm*—Fitzpatrick, Cella, Harper & Scinto

[57] ABSTRACT

An electrophotographic photosensitive member comprising a photosensitive layer formed by coating of a coating solution containing a photoconductive compound on a electroconductive substrate followed by drying, said electroconductive substrate having a $C/\rho$ value of 0.250 or less when the heat capacity per unit surface area of said electroconductive substrate is made C cal/cm$^2$.°C. and the thermal conductivity of the material for said electroconductive substrate is made $\rho$ cal/cm.sec.°C.

33 Claims, 4 Drawing Figures

ELECTROPHOTOGRAPHIC PHOTOSENSITIVE MEMBER AND PREPARATION THEREOF

BACKGROUND OF THE INVENTION

1. Field of the Invention

This invention relates to improvement of an electrophotographic member having a coated film formed by coating and drying a coating solution containing a photoconductive compound on a cylindrical substrate surface.

2. Description of the Prior Art

As the method for preparation of electrophotographic photosensitive members currently employed, there have been adopted the methods in which Se, Se-Te, $As_2Se_3$, $Sb_2S_3$, $Sb_2Se_3$, CdS or Si is provided on electroconductive substrates in various manners such as vapor deposition, or in which coating solutions comprising dispersions of inorganic or organic photoconductive pigments or solutions of organic photoconductive compounds, which may contain binder resins if desired, are coated on electroconductive substrates, followed by the step of drying, to produce photosensitive members.

In particular, the production method according to the latter coating—drying steps, which enables continuous production, may be said to be advantageous in aspect of the preparation steps.

As the photosensitive members applicable in these preparation steps, there have been known products coated with resin dispersions of CdS, ZnO, $TiO_2$, etc. and optionally added sensitizers, or solutions of organic photoconductive compounds such as polyvinylcarbazole containing appropriate sensitizers. Also, in recent years, as the coating type photosensitive members, there have been developed so called organic type functionally separated type photosensitive members prepared by coating and drying dispersions of phthalocyanine type compounds, perylene type compounds, azo type compounds, quinacridone type compounds or other various organic type dyes or pigments to form a charge generating layer and then coating and drying resin solutions containing compounds such as pyrazoline derivatives, hydrazone derivatives, diphenylmethane derivatives, triphenylmethane derivatives, triphenylamine derivatives, oxadiazole derivatives, benzooxazole derivatives, styryl dye base derivatives and others to form a charge transport layer; or photosensitive members prepared by coating solutions of co-crystalline complexes of dyes and resins. These photosensitive members are not only excellent in sensitivity and durability but also advantageous in production aspect such as processability, cost, etc., and therefore they find uses in various applications of which scope is still becoming wider.

However, while the coating type photosensitive members have the advantages in that they can be continuously produced, and so on, unevenness in heating in the drying step causes sensitivity irregularities or charging irregularities which are problems in characteristics of the photosensitive members, thus being the primary cause for lowering of yield. As the possible reasons why the scattering in the drying step leads to the defects in the electrophotographic characteristics, there may be considered the problem that uneven heating may result in partially differing vaporization speeds of the solvent, whereby the concentrations of the molecules or particles of photoconductive compounds or sensitizers contained in the binder resin may become ununiform or that partial difference may be formed in micro-Brownian movements of molecules or particles of the photoconductive compounds or sensitizers, to result in causing an ununiform agglomerated state. When drying is completed under the state where such a partial unevenness is created, irregularities in characteristics appear to be generated in the electrophotographic photosensitive member. In the prior art, with regard to the drying step in the preparation steps, it is practiced with elaborations on the device or with the greatest care while setting severe drying conditions. Nevertheless, under the present situation, the drying step is still a cause for generation of unacceptable products.

In particular, this tendency is further pronounced in the functionally separated type photosensitive members or the photosensitive members comprising co-crystalline complexes as mentioned above. That is, the drying step is a cause for giving rise to generation of irregularities in characteristics in the photosensitive members, since in such functionally separated type photosensitive members, the pigment particles employed for the charge generating layer are extremely minute and therefore influenced greatly by the Brownian movements to be prone to cause agglomeration, while in case of co-crystalline complexes, it is liable to have influences on thermal equilibrium in formation of complexes.

At present, concerning these coating type photosensitive members, especially the functionally separated type photosensitive members or the co-crystalline complex type photosensitive members susceptible to the problems in the drying step, as an example to countermeasure generation of drying irregularities, there is the method in which a sheet-shaped substrate is employed. A sheet-shaped substrate, which is rolled in a form of roll as the original plate, is subjected continuously to the coating step, the drying step and the cutting step to be worked into a photosensitive member. In the drying step, it is possible to use a drying furnace which can be designed so as to perform drying for a relatively long time, whereby more uniform drying can be effected by gradual heating and gradual cooling. Further, it is also possible to adopt such a constitution that a dry hot air is evenly blown against the coated surface, thus avoiding uneven heating.

On the other hand, when a sheet-shaped photosensitive member is applied to a copying machine, the copying step is performed with said member mounted on a belt-shaped or drum-shaped driving support. During this operation, due to the presence of the seam of the sheet-shaped photosensitive member, it is necessary to provide the body of copying machine with a registration mechanism during copying, and also the operations at the time of exchange of the sheet-shaped photosensitive member are complicated. Further, the sheet-shaped photosensitive member is required to have a surface area greater than the size of originals to be copied, thus involving inherently the problems in designing of a copying machine such that the body of copying machine becomes greater in size.

In view of the various points as mentioned above in designing of a copying machine, a photosensitive member may desirably of a cylindrical shape without a seam and of a type uniformly coated. However, a solution containing a photoconductive compound coated on a cylindrical substrate, unlike the aforesaid sheet-shaped substrate, can hardly be dried evenly. For example, when considering a drying machine structure in which a coated cylindrical photosensitive member is continuously moved through a drying furnace, although gradual heating and gradual cooling may be possible during the step, it is impossible to blow a dry hot air evenly at any individual portion on the surface of the photosensitive member. Further, in a device with a constitution wherein one photosensitive member is placed in one drying furnace for drying, heating may be applied evenly on the entire surface of the photosensitive member from the surrounding, but such a constitution is not practical in aspect of continuous production, because it will take a relatively longer time for drying.

In the prior art, in the production of an electrophotographic photosensitive member comprising coating and drying steps, various investigations have been made about the coating techniques and, not depending on the shape or the material of the substrate, homogeneous coated films can be obtained with a uniform thickness and without irregularity. On the other hand, the drying step in case of using a cylindrical substrate, unlike the case of using a sheet-shaped substrate, has not been investigated consistently but the drying conditions are adjusted in conformity with the manner of the step, and such a technique may be said to be one belonging to the region of know-how. Moreover, uniformity in the drying step cannot be judged to be good or bad simply by visual observation, but the product is required to be good and uniform in the potential characteristic.

SUMMARY OF THE INVENTION

The present inventors, in view of the various points as mentioned above, have found that a cylindrical photosensitive member free from the defects in the drying step at the time of production of the photosensitive member can be obtained by improvement of the thermal characteristic of the cylindrical substrate.

Accordingly, it is an object of the present invention to provide a cylindrical electrophotographic photosensitive member which can be prepared by coating and drying steps at a high production yield.

Another object of the present invention is to provide an electrophotographic photosensitive member of which bulk production is made possible with stable quality.

A further object of the present invention is to provide an electrophotographic photosensitive member which is advantageous in designing the body of a copying machine or its cost.

Other objects of the present invention will be apparent from the following description.

According to an aspect of the present invention, there is provided an electrophotographic photosensitive member comprising a photosensitive layer formed by coating of a coating solution containing a photoconductive compound on an electroconductive substrate followed by drying, said electroconductive substrate having a $C/\rho$ value of 0.250 or less when the heat capacity per unit surface area of said electroconductive substrate is made C cal/cm$^2$.°C. and the thermal conductivity of the material for said electroconductive substrate is made $\rho$ cal/cm.sec.°C.

According to another aspect of the present invention, there is provided a process for producing an electrophotographic photosensitive member comprising the steps of dipping a cylindrical electroconductive substrate with a $C/\rho$ value of 0.250 or less when the heat capacity per unit surface area of said cylindrical electroconductive substrate is made C cal/cm$^2$.°C. and the thermal conductivity of the material for said cylindrical electroconductive substrate is made $\rho$ cal/cm.sec.°C. into a coating solution containing a photoconductive compound, drawing up the cylindrical electroconductive substrate from said coating solution and drying the coated film formed on said cylindrical electroconductive substrate.

According to a further aspect of the present invention, there is provided a process for producing an electrophotographic photosensitive member comprising the steps of dipping a cylindrical electroconductive substrate with a $C/\rho$ value of 0.250 or less when the heat capacity per unit surface area of said cylindrical electroconductive substrate is made C cal/cm$^2$.°C. and the thermal conductivity of the material for said cylindrical electroconductive substrate is made $\rho$ cal/cm.sec.°C. into a coating solution for a charge generating layer containing a substance for generating charges, drawing up the cylindrical electroconductive substrate from said coating solution for the charge generating layer, drying the coated film for the charge generating layer formed on said cylindrical electroconductive substrate, dipping said cylindrical electroconductive substrate into a coating solution for a charge transport layer containing a charge transporting substance, drawing up the cylindrical electroconductive substrate from said coating solution for the charge transport layer and drying the coated film for the charge transport layer formed on said cylindrical electroconductive substrate.

DETAILED DESCRIPTION OF THE PREFERRED EMBODIMENTS

Figure 1:
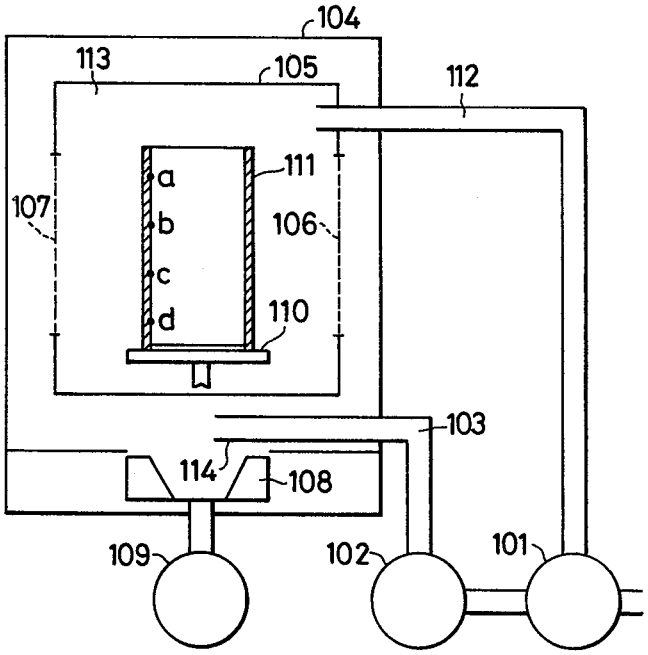
FIG. 1 is a cross-sectional view of a drying device used in Examples.

The present inventors have made investigations on the drying conditions when using a cylindrical substrate such as (1) constitution of drying machine, (2) material and quality of substrate, (3) thermal characteristic of substrate or (4) coating solvent, and consequently found that the substrate is required to have thermal characteristics which satisfy certain conditions. Of course, other various conditions are indispensable factors for uniform drying, but even if these conditions may be preferable, insufficient thermal characteristics of the substrate will bring about lowering in the percentage of good products by drying. In particular, this tendency was more marked when the photosensitive layer is materially incontinuous as in case of a dispersed system of pigments or a co-crystalline complex system or when the coated film is a thin layer.

The correlation between generation of irregularities in the drying step for these photosensitive members and the thermal characteristics of the substrate is to be summarized below. That is, as the photosensitive member susceptible to generation of failures in the drying step, there was employed the charge generating layer of a functionally separated type organic electrophotographic photosensitive member, as shown in Example 1 to be described below, for examination of the thermal characteristics of the substrate and the causes for generation of drying irregularities. The coating solution for this charge generating layer is prepared by dispersing β-type copper phthalocyanine in a polyvinyl butyral resin with the use of cyclohexanone and methyl ethyl ketone as the solvent by means of a sand mill, and the P/B ratio [weight ratio of P (pigment) to B (binder)] is 1.0 and the ratio of the solid relative to the solvent is 4% by weight. The coating solution prepared was coated on the surfaces of various kinds of cylindrical substrates with different thermal characteristics according to the dipping and draw-up method to a wet thickness of 5 μm. Then, in a hot air drier at 130° C., the substrate temperature was elevated to 120° C. and thereafter drying was conducted for 10 minutes. The film thicknesses after drying were found to be 0.21 to 0.22 μm. On the charge generating layers thus obtained were coated as the charge transport layers a polymethylmethacrylate solution having dissolved p-diethylaminobenzaldehyde-N,N-diphenyl hydrazone therein to a dried film thickness of 15 μm to prepare photosensitive members. Separately, the charge transport layer was singly formed on a photoconductive substrate for the purpose of confirming absence of drying irregularities. The charge transport seems to suffer from little influence from drying, because it is materially homogeneous and thick in film thickness. Accordingly, the potential irregularities of the thus prepared photosensitive members may be judged to be due to the difference in the thermal characteristics of the substrates during drying of the charge generating layers.

The cylindrical substrates employed here have an outer diameter of 80 mmϕ and a length of 400 mm, with the materials and thicknesses being varied, and have respective thermal characteristics as shown in Table 1 below.

TABLE 1

| Cylindrical substrate sample | Material | Heat capacity per unit surface area C cal/cm.$^2$ °C. | Thermal conductivity ρ cal/cm. sec. °C. |
|---|---|---|---|
| (A) | Aluminum | 0.029 | 0.53 |
| (B) | " | 0.056 | 0.53 |
| (C) | " | 0.116 | 0.53 |
| (D) | " | 0.175 | 0.53 |
| (E) | Copper | 0.170 | 0.94 |
| (F) | Chromium stainless steel | 0.085 | 0.06 |
| (G) | Stainless steel | 0.087 | 0.15 |
| (H) | 7/3 Brass | 0.077 | 0.27 |

The heat capacity C per unit surface area (standard temperature: 25° C.) was measured in a conventional manner by cutting a certain area of the cylindrical substrate. The substrates (A) to (D) employ the same material, but they have different thermal capacities per unit surface area due to the difference in thickness, which is varied from about 0.5 to 3.0 mm.

Figure 2:
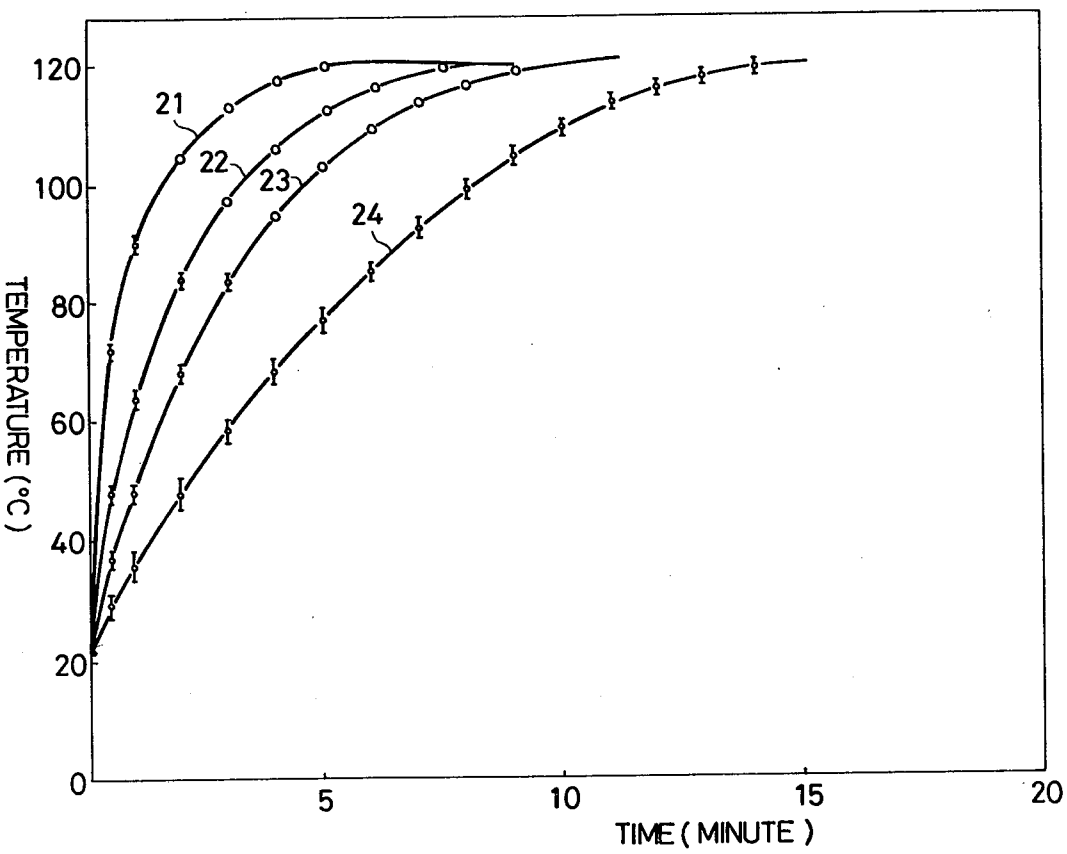
FIG. 2 is a graph for illustration of the temperature elevation characteristics of the cylindrical substrates (A), (B), (C) and (D).

On these substrates were formed the charge generating layers as described above and, for the purpose of minimizing the influences from the drying conditions or the constitution of a drier, there was employed a drier experimentally prepared of which schematic sectional view is shown in FIG. 1. The drier in FIG. 1 is devised so that uniform heating may be applied on the entire surface of the cylindrical photosensitive member. That is, the air heated by the heater 101 is blown by means of the blower 102 through the blasting duct 103 into the hollow portion between the outer wall 104 and the inner wall 105 of the drying furnace. The drying hot air is delivered through the opening portions 106 and 107 provided at the inner wall 105 into the inner-furnace 113, while the fan 108 is rotated by the motor 109 near the blasting duct outlet 114 so that the hot air in the inner-furnace 113 may be circulated evenly. In the inner-furnace 113 is provided the supporting stand 110, on which the cylindrical photosensitive member 111 to be dried is mounted. The supporting stand is rotatable by a motor (not shown) and the hot air delivered from around the inner wall 105 is blown evenly against the surface of the photosensitive member 111. The hot air employed for drying is discharged through the exhaust duct 112. The specific feature of the drier in FIG. 1 resides in the structure which enables the hot air kept constantly at a certain temperature to be delivered over the entire surface of the cylindrical photosensitive member, and it is also possible to control the drying conditions by the output of the power source of the heater and the air flow rate from the blower, rotational number of the fan, the rotational number of the supporting stand and the dumpers provided elsewhere in the duct. As a method for setting the drying conditions, a cylindrical electroconductive substrate not coated with a solution for preparation of a photosensitive member is used and on its inner surface is set a probe of a thermocouple thermometer at positions which are varied as shown by a, b, c and d in FIG. 1, and the conditions are selected so that the temperature difference from place to place may be the minimum. The flow rate of the air was controlled under as mild conditions as possible to give an necessary amount of the air for discharging the solvent vapor within the drying time. The appropriate conditions for drying the aforesaid charge generating layer were found to be a blower flow rate of 1 m$^3$/min., a hot air temperature of 130° C. and a rotational number of the substrate supporting stand of 15 rpm for an inner-furnace volume of 0.15 m$^3$. The temperature elevation curves of the substrates are shown in FIG. 2. The temperature elevation curve 21 shown in FIG. 2 corresponds to the cylindrical substrate (A), the curve 22 to the substrate (B), the curve 23 to the substrate (C) and the curve 24 to the substrate (D). The plots on the curves indicate the average value, the maximum value and the minimum value at the measuring positions a, b, c and d. The potential irregularities of the photosensitive member prepared under such conditions may be said to be due to the difference in the thermal characteristics of the substrates during the step of drying the charge generating layers.

Figure 3:
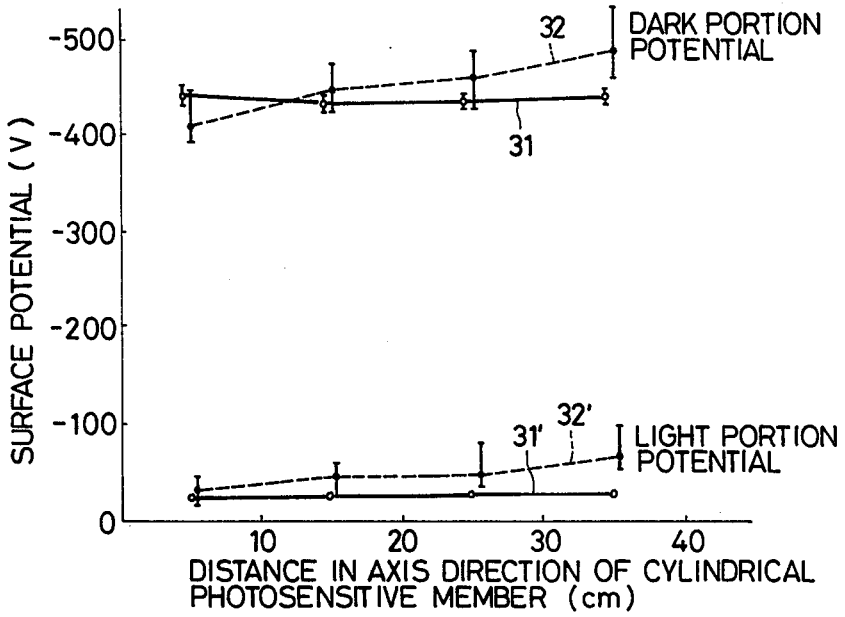
FIG. 3 is a graph for illustration of the potential characteristics of photosensitive members prepared by use of the cylindrical substrates (B) and (D).

FIG. 3 shows the potential characteristics of the photosensitive members prepared by use of the cylindrical substrate samples (B) and (D) as shown in Table 1. The potential characteristic was measured by mounting a photosensitive member on a copying machine modified for measurement, charging the photosensitive member by means of a corona discharger at an application voltage of ⊖6 KV while setting the photosensitive member on rotation and then applying exposure thereon. Measurement was conducted at the positions corresponding to the temperature measuring positions a, b, c and d in FIG. 1 relative to the axis direction of the cylindrical photosensitive member along its circumferential direction. The aixs of abscissa in FIG. 3 represents positions in the longer direction of photosensitive members, and the plots in the Figure from the left side correspond to the positions of a, b, c and d, respectively. The axis of ordinate represents surface potentials of photosensitive members.

The plots in FIG. 3 indicate average values, maximum values and minimum values of surface potentials in the circumference at one point in the longer direction of the cylindrical photosensitive member. That is, the scattering of these potentials can be evaluated as the potential irregularities. The curves 31 and 31' show the dark portion potential and the light portion potential of the photosensitive member prepared on the substrate sample (B), while the curves 32 and 32' the dark portion potential and the light potion potential of the photosensitive member prepared on the substrate sample (D).

What can be judged from these results is that the photosensitive member employing the substrate sample (B) is small in potential fluctuation in the longer direction and the circumferential direction of the cylindrical photosensitive member, only with a difference of about 20 V at the dark portion potential. In contrast, when the substrate sample (D) is employed, there occurred potential irregularities of 130 V at the dark portion potential and 43 V at the light portion potential. Particularly, irregularities at the light portion may cause ground fogging or contamination of the images which are not favorable in the copying step. Generation of these potential irregularities may be considered to be ascribable to the thermal characteristics of the substrate in the step of drying the charge generating layer. Inhomogeneous agglomeration or partial concentration changes of the dispersed particles of $\beta$-copper phthalocyanine upon drying may also be considered to be responsible for the phenomenon. The difference in the thermal characteristics between the substrate samples (B) and (D) lies in the heat capacity per unit surface area, and a slight temperature scattering is observed at the initial stage of temperature elevation of the substrate (D) with greater heat capacity, as shown in the temperature elevation curve in FIG. 2. The curves in FIG. 2 show temperature elevations of the substrates alone, and, when photosensitive member forming solutions are coated thereon, the temperature scattering at the initial stage of drying may be estimated to have delicate influence on formation of the photosensitive layer.

That is, when the photosensitive layer is materially incontinuous as in a dispersed system, the coating layer at the initial stage of drying still contains a sufficient amount of a solvent and has a low viscosity. Therefore, the dispersed particles are thermally freely movable. Under such a state, if a partial temperature distribution is created on the substrate, it can be understood that inhomogeneous agglomeration or partial concentration changes may be brought about. The initial stage of drying is under the process of abundant vaporization of the solvent, whereby the difference in temperature between the photosensitive member and the surrounding is at its maximum. In view of this point, the thermal process which actually takes place may be said to be more complicated than the temperature distribution at the time of temperature elevation of substrates alone as shown in FIG. 2. For example, thermal convection including the coated layer may be considered to occur.

Anyway, as the result of the investigations as described above, in case of materially incontinuous systems such as the dispersed system or co-crystalline complex system, it will be understood that in the drying step, the thermal characteristics of substrates give important factors to generation of potential irregularities of the photosensitive members. Particularly, from such a point of view, one may liable to think that by use of a substrate having a high thermal conductivity, even when the heat given for drying may be partially ununiform, a state with little temperature distribution would be accomplished through rapid diffusion of the heat. However, as apparently seen from the above results, even when using the substrate samples (A)-(D) of aluminum with relatively higher thermal conductivity, the difference in heat capacity per unit surface area has an influence on the coated film of dispersed system. In other words, it is necessary to consider the thermal process when a temperature distribution takes place, for example, the thermal convection in the thickness direction of the substrate, vaporization latent heat of the solvent or thermal free movements of dispersed particles or polymers, and drying proceeds through mutual relations between these factors. As for the thermal characteristic of the substrate, it is ideally desirable that the substrate may have a very high thermal conductivity and a very small heat capacity so as to create no temperature gradient in the thickness direction within the substrate. When the heat capacity is large, it will have increased influences on important factors in formation of the photosensitive layer such as vaporization of the solvent at the initial stage of drying or thermal movements of the particles.

Figure 4:
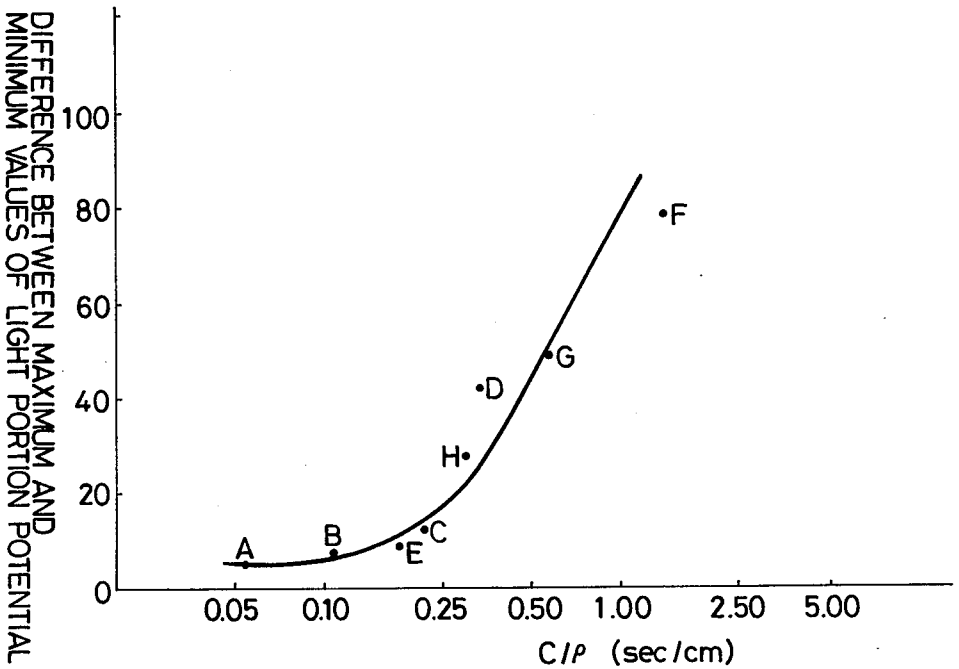
FIG. 4 is a graph for illustration of the relation between the fluctuated potentials of the photosensitive members prepared by use of the cylindrical substrates (A) to (H) and $C/\rho$ values of the cylindrical substrates.

Along the way of thinking as described above, the relation between the thermal characteristics of the substrate samples (A) to (H) with variously different materials and the potential irregularities of the photosensitive members due to ununiformity of the charge generating layers formed in the drying step was formulated. As the result, it was confirmed that drying can be effected very uniformly on a substrate satisfying the following thermal characteristic:

$$C/\rho \leqq 0.250 \text{ sec/cm}$$

wherein C (cal/cm$^2$.°C.) is the heat capacity of the substrate per unit surface area and $\rho$ (cal/cm.sec.°C.) is the thermal conductivity of the substrate. For example, FIG. 4 shows the results of measurements of $C/\rho$ and the potential irregularities when the dispersion of $\beta$-copper phthalocyanine as previously mentioned was coated and dried. The axis of abscissa in FIG. 4 is $C/\rho$ of the substrate, and the axis of ordinate is the difference between the maximum value and the minimum value of the light portion potential in the same photosensitive member which will readily influence the copied image, namely the so called potential irregularity. The plots A to H in FIG. 4 correspond to the substrate samples (A) to (H) as shown in Table 1. As apparently seen from FIG. 4, at $C/\rho \leqq 0.250$ sec/cm, unfavorably great potential irregularities were created. These irregularities did not depend on the materials of the substrates.

The above investigations clearly show that, when forming a materially incontinuous photosensitive layer in a form of a thin film, the substrate is required to have the thermal characteristic satisfying the relation: $C/\rho \leqq 0.250$ sec/cm. $C/\rho$, as can be apparently seen from its unit, represents how rapid the ununiform temperature distribution once occurring in the photosensitive member during the drying step can be compensated, and it is determined by the thermal conductivity and the heat capacity per unit surface area of the substrate. It is also preferred that the thermal conductivity $\rho$ of the material of the cylindrical substrate is 0.02 cal/cm.sec.°C. or more.

The above description has been made by referring to an embodiment in which a charge generating layer containing as the charge generating substance $\beta$-copper phthalocyanine for illustration of the influence of the thermal characteristics of substrates. It will be apparent from the above description that the present invention can be effectively applied for various photosensitive members, because the thermal characteristics of the substrate bear the essential role in compensation of the temperature distributions occurring in the drying step.

The photoconductive compounds to be used in the present invention, particularly the charge generating substances to be used in the aforesaid charge generating layer, may be selected from a wide scope of compounds. For example, the compounds as enumerated below are preferable.

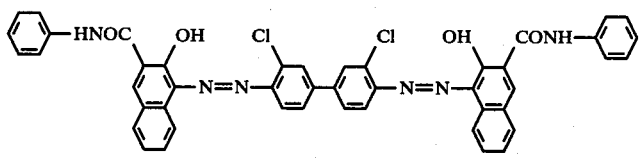

(1)

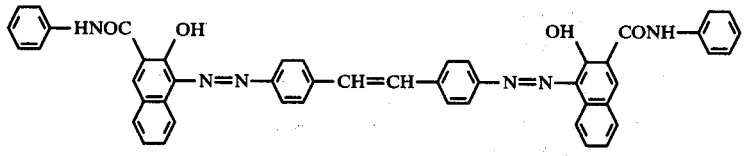

(2)

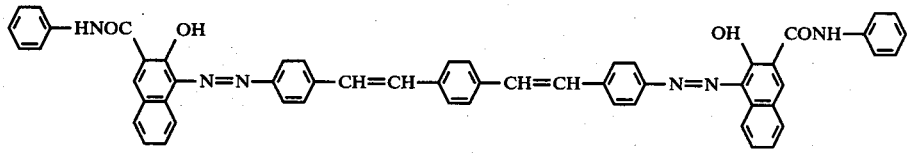

(3)

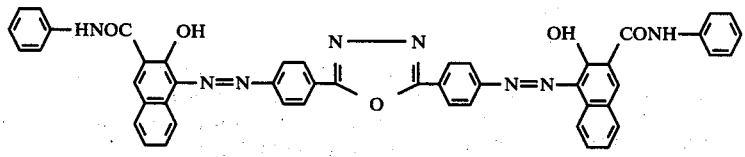

(4)

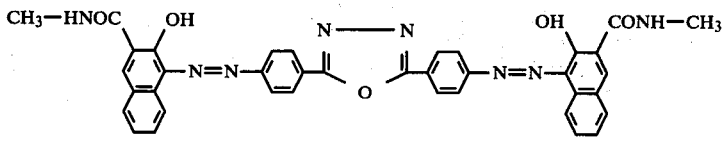

(5)

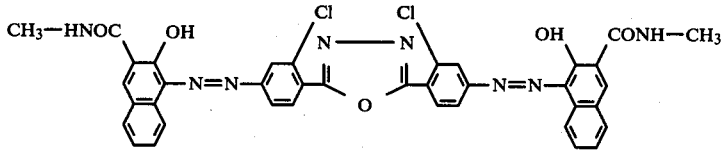

(6)

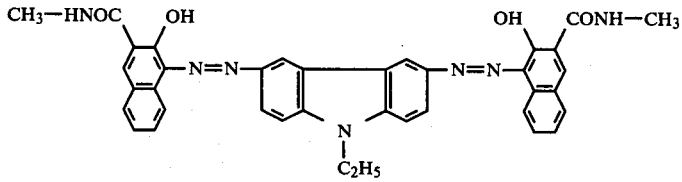

(7)

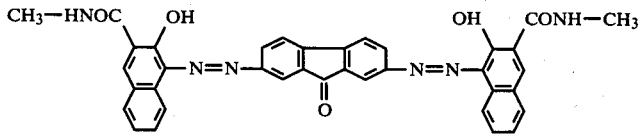

(8)

-continued (9)

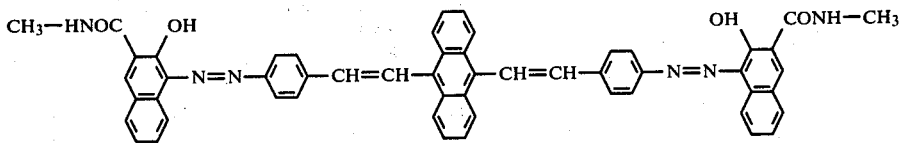

(10)

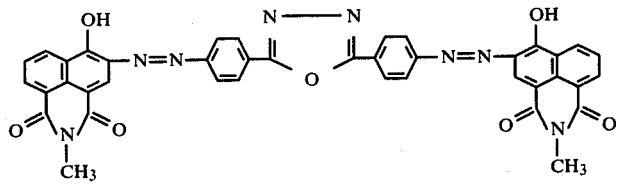

(11)

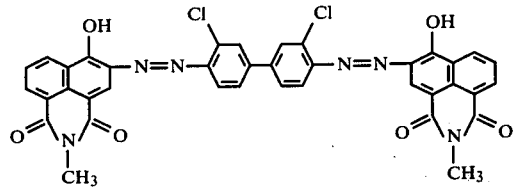

(12)

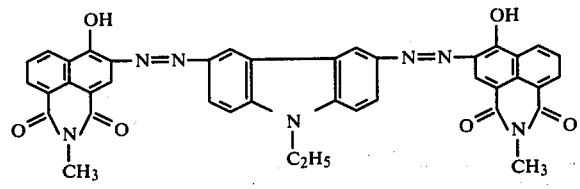

(13)

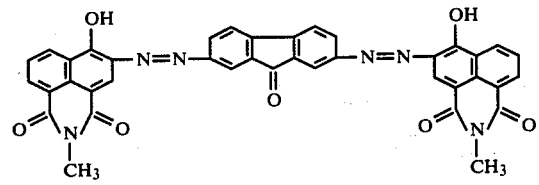

(14)

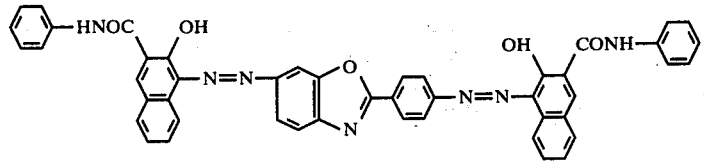

(15)

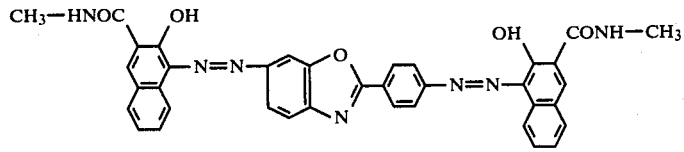

(16)

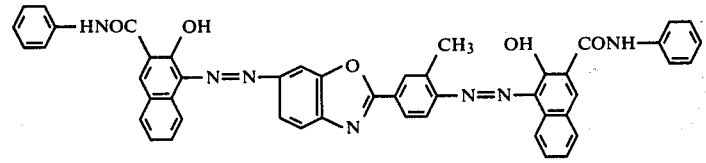

(17) Copper phthalocyanine

(18) Cadmium sulfide

(19) Squaric acid dyes (as disclosed in U.S. Pat. No. 3,824,099)

The co-crystalline complexes of a pyrylium or thiopyrylium dye and a polymer can be obtained according to the process as disclosed in, for example, U.S. Pat. No. 3,684,502. As the pyrylium and thiopyrylium dyes forming the co-crystalline complexes, there may be preferably employed the following exemplary compounds.

(1)
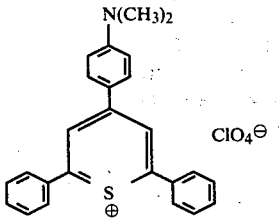
(2)
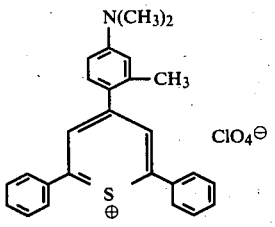
(3)
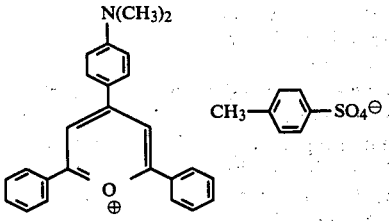
(4)
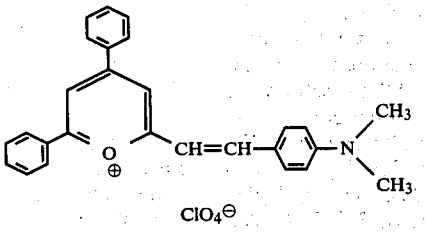
(5)
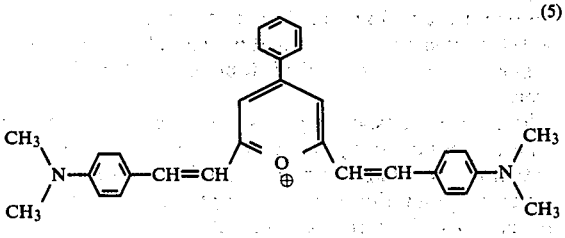
(6)
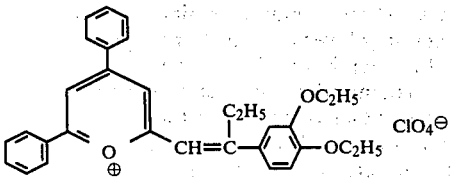
(7)
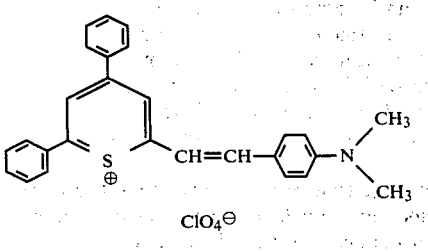
-continued
(8)
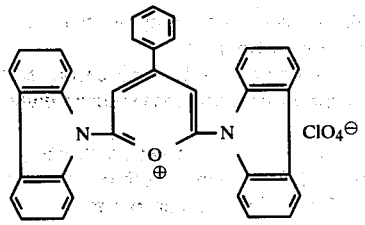
(9)
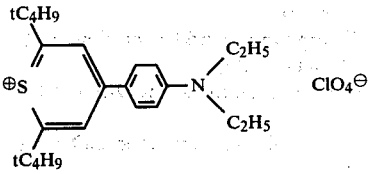
(10)
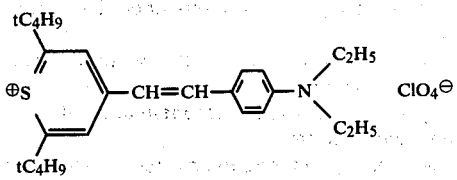
(11)
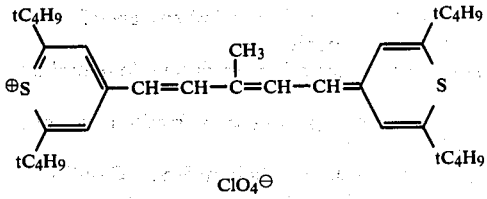
(12)
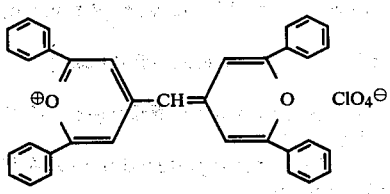
(13)
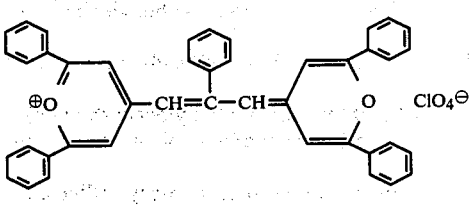
(14)
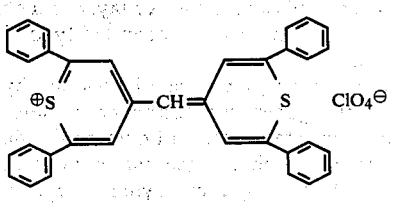
(15)
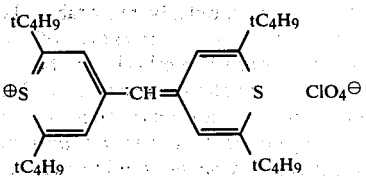
Polymers having repeating units of alkylidene arylene moieties capable of forming co-crystalline complexes with those pyrylium type dyes are exemplified below:

1: Poly(4,4'-isopropylidenediphenylene-CO-1,4-cyclohexyldimethylcarbonate)
2: Poly(3,3'-ethylenedioxyphenylenethiocarbonate)
3: Poly(4,4'-isopropylidenediphenylenecarbonate-CO-1,4-terephthalate)
4: Poly(4,4'-isopropylidenediphenylenecarbonate)
5: Poly(4,4'-isopropylidenephenylenethiocarbonate)
6: Poly(2,2-butanebis-4-phenylenecarbonate)
7: Poly(4,4'-isopropylidenediphenylenecarbonate-block-ethyleneoxide)
8: Poly(4,4'-isopropylidenediphenylenecarbonate-block-tetramethyleneoxide)
9: Poly[4,4'-isopropylidenebis(2-methylphenylene)carbonate]
10: Poly(4,4'-isopropylidenephenylene-CO-1,4-phenylenecarbonate)
11: Poly(4,4'-isopropylidenediphenylene-CO-1,3-phenylenecarbonate)
12: Poly(4,4'-isopropylidenediphenylene-CO-4,4'-diphenylenecarbonate)
13: Poly(4,4'-isopropylidenediphenylene-CO-4,4'-oxydiphenylenecarbonate)
14: Poly(4,4'-isopropylidenediphenylene-CO-4,4'-carbonyldiphenylenecarbonate)
15: Poly(4,4'-isopropylidenediphenylene-CO-4,4'-ethylenediphenylenecarbonate)
16: Poly[4,4'-methylenebis(2-methylphenylene)carbonate]
17: Poly[1,1-(P-bromophenylethane)bis(4-phenylene)carbonate]
18: Poly[4,4'-isopropylidenediphenylene-CO-sulfonylbis(4-phenylene)carbonate]
19: Poly[4,4'-isopropylidenebis(2-chlorophenylene)carbonate]
20: Poly(hexafluoroisopropylidene-di-4-phenylenecarbonate)
21: Poly(4,4'-isopropylidenediphenylene-4,4'-isopropylidenedibenzoate)
22: Poly(4,4'-isopropylidenedibenzyl-4,4'-isopropylidenedibenzoate)
23: Poly[2,2-(3-methylbutane)bis-4-phenylenecarbonate]
24: Poly[2,2-(3,3-dimethylbutane)bis-4-phenylenecarbonate]
25: Poly(1,1-[1-(naphthyl)]bis-4-phenylenecarbonate)
26: Poly[2,2-(4-methylpenane)bis-4-phenylenecarbonate]

The coated film containing such a co-crystalline complex can be used as a photoconductive layer or a charge generating layer of a functionally separated type photosensitive member.

The charge generating layer may be formed by dispersing the charge generating substance as described above in an appropriate binder and coating the dispersion on a substrate. The charge generating layer may be formed to a film thickness, after drying, of 5$\mu$ or less, preferably 0.01 to 1$\mu$, particularly preferably 0.05$\mu$ to 0.5$\mu$. The binder to be used in formation of a charge generating layer by coating method can be selected from a wide scope of insulating resins and also from organic photoconductive polymers such as poly-N-vinylcarbazole, polyvinylanthracene or polyvinylpyrene. Preferably, there may be included insulating resins such as polyvinyl butyral, polyarylate (for example, condensed polymers of bisphenol A and phthalic acid), polycarbonates, polyesters, phenoxy resins, polyvinyl acetate, acrylic resins, polyacrylamide resins, polyamides, polyvinylpyridine, cellulose type resins, urethane resins, epoxy resins, casein, polyvinyl alcohols, polyvinyl pyrrolidone and so on. The content of the resin in the charge generating layer may suitably be 80% by weight or less, preferably 40% by weight or less. As the organic solvent to be used in coating, there may be employed alcohols such as methanol, ethanol, isopropanol and the like; ketones such as acetone, metyl ethyl ketone, cyclohexanone and the like; amides such as N,N-dimethylformamide, N,N-dimethylacetamide and the like; sulfoxides such as dimethyl sulfoxide and the like; ethers such as tetrahydrofuran, dioxane, ethyleneglycol monomethylether and the like; esters such as methyl acetate, ethyl acetate and the like; aliphatic halogenated hydrocarbons such as chloroform, methylene chloride, dichloroethylene, carbon tetrachloride, trichloroethylene and the like; aromatic compounds such as benzene, toluene, xylene, ligroin, monochlorobenzene, dichlorobenzene and the like. The content of the solvent in the coating liquid may be 80% by weight or more, preferably 90% by weight or more, particularly 95% by weight or more.

Coating may be performed according to dip coating, spray coating, spinner coating, bead coating, Myer bar coating, blade coating, roller coating, curtain coating or other methods, but dip coating is suitable for the present invention. The dip coating may be practiced by dipping the above-mentioned cylindrical electroconductive substrate into a pot filled with a coating liquid containing a photoconductive compound and drawing up the substrate at a constant speed or at a reduced speed, whereby a wet coated film can be uniformly formed on the surface of the substrate. It is preferred that the cylindrical electroconductive substrate may have an outer diameter of 80 mm or less. The coated product may be dried by heating drying after set to tough at room temperatures. The heating drying may be conducted at a temperature of 30° C. to 200° C. for a period in the range from 5 minutes to 2 hours either under stationary state or with air blowing. The set to touch refers to a dried state of such an extent that no coated film sticks to a finger when the coated film is touched lightly with the finger.

The charge transport layer is electrically connected to the aforesaid charge generating layer and has the function of receiving the charge carriers injected from the charge generating layer in the presence of an electric field as well as the function of transporting these charge carriers to the surface. For this purpose, the charge transport layer may be laminated either on the charge generating layer or beneath the charge generating layer. However, it is preferred that the charge transport layer is laminated on the charge generating layer.

The photoconductive substance for transporting the charge carriers in the charge transport layer (hereinafter referred to merely as charged transporting substance) may preferably be substantially non-sensitive to the wavelength region of an electromagnetic wave to which the aforesaid charge generating layer is sensitive. The "electromagnetic wave" herein mentioned is inclusive of the definition in a broad sense of the "ray of light", including gamma-ray, X-ray, UV-ray, visible light ray, near infrared rays, infrared rays, for infrared rays, etc.

As the charge transporting substances, there are electron transporting substances and positive hole transporting substances. As the electron transporting substances, there may be included electron attracting substances such as chloroanil, bromoanil, tetracyanoethylene, tetracyanoquinodimethane, 2,4,7-trinitro-9-fluorenone, 2,4,5,7-tetranitro-9-fluorenone, 2,4,7-trinitro-9-dicyanomethylenefluorenone, 2,4,5,7-tetranitroxanthone, 2,4,8-trinitrothioxanthone and the like, or polymers of these electron attracting substances.

As the positive hole transporting substances, there are pyrene, N-ethylcarbazole, N-isopropylcarbazole, N-methyl-N-phenylhydrazino-3-methylidene-9-ethylcarbazole, N,N-diphenylhydrazino-3-methylidene-9-ethylcarbazole, N,N-diphenylhydrazino-3-methylidene-10-ethylphenothiazine, N,N-diphenylhydrazino-3-methylidene-10-ethylphenoxazine, hydrozones such as P-diethylaminobenzaldehyde-N,N-diphenylhydrazone, P-diethylaminobenzaldehyde-N-α-naphthyl-N-phenylhydrazone, P-pyrolidinobenzaldehyde-N,N-diphenylhydrazone, 1,3,3-trimethylindolenine-ω-aldehyde-N,N-diphenylhydrazone, P-diethylbenzaldehyde-3-methylbenzthiazolinone-2-hydrazone and the like, 2,5-bis(P-diethylaminophenyl)-1,3,4-oxadiazole, pyrazolines such as 1-phenyl-3-(P-diethylaminostyryl)-5-(P-diethylaminophenyl)pyrazoline, 1-[quinolyl(2)]-3-(P-diethylaminostyryl)-5-(P-diethylaminophenyl)pyrazoline, 1-[pyridyl(2)]-3-(P-diethylaminostyryl)-5-(P-diethylaminophenyl)pyrazoline, 1-[6-methoxy-pyridyl(2)]-3-(P-diethylaminostyryl)-5-(P-diethylaminophenyl)-pyrazoline, 1-[pyridyl (3)]-3-(P-diethyl aminostyryl)-5-(P-diethylaminophenyl) pyrazoline, 1-[pyridyl(2)]-3-(P-diethylaminostyryl)-5-(P-diethylaminophenyl)pyrazoline, 1-[pyridyl(2)-3-(P-diethylaminostyryl)-4-methyl-5-(P-diethylaminophenyl) pyrazoline, 1-[pyridyl(2)]-3-(α-methyl-P-diethylaminostyryl)-5-(P-diethylaminophenyl)pyrazoline, 1-phenyl-3-(P-diethylaminostyryl)-4-methyl-5-(P-diethylaminophenyl)pyrazoline, 1-phenyl-3-(α-benzyl-P-diethylaminostyryl)-5-(P-diethylaminophenyl)pyrazoline, spiropyrazoline and the like, oxazole type compounds such as 2-(P-diethylaminostyryl)-6-diethylaminobenzoxazole, 2-(P-diethylaminophenyl)-4-(P-dimethylaminophenyl)-5-(2-chlorophenyl)oxazole and the like, thiazole type compounds such as 2-(P-diethylaminostyryl)-6-diethylaminobenzothiazole and the like, triarylmethane type compounds such as bis(4-diethylamino-2-methylphenyl)-phenylmethane and the like, polyarylalkanes such as 1,1-bis(4-N,N-diethylamino-2-methylphenyl)-heptane, 1,1,2,2-tetrakis(4-N,N-dimethylamino-2-methylphenyl)-ethane and the like, styryls, triphenylamine, poly-N-vinylcarbazole, polyvinylpyrene, polyvinylanthracene, polyvinylacridine, poly-9-vinylphenylanthracene, pyrene-formaldehyde resin, ethylcarbazole-formaldehyde resin, and so on.

These charge transporting substances may be used as a single kind or as a combination of two or more kinds.

When the charge transporting substance has no film forming property, a coated film can be formed by use of an appropriately selected binder. The resins available as the binder may include, for example, insulating resins such as acrylic resins, polyarylate, polyester, polycarbonate, polystyrene, acrylonitrilestyrene copolymer, acrylonitrile-butadiene copolymer, polyvinyl butyral, polyvinyl formal, polysulfone, polyacrylamide, polyamide, chlorinated rubber, etc. or organic photoconductive polymers such as poly-N-vinylcarbazole, polyvinylanthracene, polyvinylpyrene and so on.

The charge transporting layer cannot be made thicker than the necessary thickness because the thickness enabling transport of charge carriers is limited. Generally, it may have a thickness of 5μ to 30μ, preferably 8μ to 20μ. For formation of the charge transport layer by coating, there may be used a suitable coating method as described above.

It is also possible to provide a subbing layer having a barrier function and an adhering function as an intermediate layer between the aforesaid cylindrical substrate and the photosensitive layer. The subbing layer may be formed of casein, polyvinyl alcohol, nitrocellulose, ethylene-acrylic acid copolymer, polyamide (nylon 6, nylon 66, nylon 610, copolymerized nylon, alkoxymethylated nylon, etc.), polyurethane, gelatin, aluminum oxide, etc.

The subbing layer may have a film thickness of 0.1μ to 5μ, preferably 0.5μ to 3μ.

In the present invention, the cylindrical electrophotographic photosensitive member can be produced at a high yield without electrophotographic failures generated during the drying step, without use of a special drying device or setting of severe drying conditions, and therefore this invention is applicable for various kinds of coated type photosensitive members. These effectivenesses will be further clarified by the following Examples.

EXAMPLE 1

Various cylindrical substrates with different thermal characteristics were prepared, and functionally separated type organic photosensitive layers were formed thereon. The thermal characteristics of the substrates and the potential irregularities of the photosensitive members due to the drying step were examined.

The cylindrical substrates prepared were the substrate samples (A) to (H) as shown in the above Table 1, and five cylinders were prepared for each sample, each cylinder having an outer diameter of 80 mmϕ and a length of 400 mm. When the heat capacity per unit surface area of the substrate is represented by C (cal/cm$^2$.°C.) and the thermal conductivity by ρ (cal/cm.sec.°C.), the C/ρ (sec/cm) values of the substrates (A) to (H) are as shown in Table 2.

TABLE 2

| Cylindrical substrate samples | Materials | C/ρ (sec/cm) |
|---|---|---|
| (A) | Aluminum | 0.055 |
| (B) | Aluminum | 0.106 |
| (C) | Aluminum | 0.220 |
| (D) | Aluminum | 0.330 |
| (E) | Copper | 0.181 |
| (F) | Chromium stainless steel | 0.417 |
| (G) | Stainless steel | 0.580 |
| (H) | 7/3 Brass | 0.285 |

The coated photosensitive layer was composed of two layers of a charge generating layer and charge transport layer, and each coating solution had the composition as shown below.

| | |
|---|---|
| (1) Solution for charge generating layer: | |
| β-type copper phthalocyanine | 1 wt. part |
| Polyvinyl butyral (SLEC-BMH produced by Sekisui Kagaku Co.) | 1 " |
| Methyl ethyl ketone | 25 " |
| Cyclohexanone | 18 " |
| (2) Solution for charge transport layer: | |
| P- -diethylaminobenzaldehyde- | 10 wt. parts |

-continued

| | |
|---|---|
| N,N—diphenylhydrazone | |
| Polymethyl methacrylate (Dianal BR-80 produced by Mitsubishi Rayon Co.) | 10 " |
| Monochlorobenzene | 80 " |

The solution for charge generating layer was dispersed by means of a sand mill dispersing machine for 20 hours before use. Coating was performed according to the dipping and draw-up method, and the dried film thicknesses were 0.21 to 0.22$\mu$ for the charge generating layer and 15$\mu$ for the charge transport layer.

Further, drying was conducted by use of a drying machine as shown in FIG. 1 under the conditions as described above. During the drying operation, the charge generating layer formed from a dispersion system was materially incontinuous and also thin in film thickness, and therefore susceptible to formation of irregularities during the drying step, while the charge transport layer which was materially homogeneous since it was thick was separately confirmed by electrophotographic means to be free from any failure during drying. Accordingly, in this Example, potential irregularities of the photosensitive members attributable to the step of drying the charge generating layers are to be evaluated.

Thus, potential irregularities were measured according to the means as described above for the five photosensitive cylinders for each sample prepared by use of the cylindrical substrates (A) to (H). The potential irregularity was evaluated by taking the difference between the maximum value and the minimum value of the potentials at the light portion in each photosensitive member and calculating the average value of the differences for the five cylinders to obtain the results as shown in Table 3. The relation between $C/\rho$ and the potential irregularity is shown in FIG. 4.

TABLE 3

| Substrate sample | (A) | (B) | (C) | (D) | (E) | (F) | (G) | (H) |
|---|---|---|---|---|---|---|---|---|
| Potential irregularity (V) | 5 | 6 | 8 | 43 | 8 | 79 | 48 | 28 |

From the above results, when the substrate has a thermal characteristic of $C/\rho$ higher than 0.250, potential irregularities of the photosensitive members were found to be liable to result from the drying step irrespectively of the kind of the material for the substrate.

EXAMPLE 2

The thermal characteristics of substrates and the potential irregularities of photosensitive members were evaluated in the same manner as in Example 1 except that the solvent compositions in the charge generating layer were changed. The substrates employed are (A) to (D) as shown in Table 1 and Table 2.

Solution (1) for charge generating layer

The mixed solvent in Example 1 was changed to methyl ethyl ketone alone.

Solution (2) for charge generation layer

The mixed solvent in Example 1 was changed to cyclohexanone alone.

These photosensitive members had the potential irregularities as shown in Table 4.

TABLE 4

| Substrate sample | | (A) | (B) | (C) | (D) |
|---|---|---|---|---|---|
| Potential irregularity (V) | Solution (1) | 12 | 10 | 15 | 55 |
| | Solution (2) | <5 | <5 | 6 | 30 |

From the above results, it can be seen that potential irregularities are liable to occur when $C/\rho>0.25$ sec/cm. Also, as in case of Solution (2), a less volatile solvent tends to be smaller in influence on the potential irregularity attributable to the drying step, but it can be said that the influence from the thermal characteristic of the substrate is greater.

EXAMPLE 3

The relation between the thermal characteristic of the substrate and the potential irregularity of the photosensitive members was examined by varying the conditions for drying the charge generating layer in Example 1. The drying conditions were those as shown in Table 5, and the temperature of the drying hot air and the air flow rate of the blower were varied. The substrates employed were samples (A) to (D) as shown in Table 1 and Table 2. The potential irregularities are also shown in Table 5.

TABLE 5

| Substrate sample: Hot air temperature (°C.) | Air flow rate ($m^3$/min.) | Potential irregularity (V) (A) | (B) | (C) | (D) |
|---|---|---|---|---|---|
| 130 | 4 | 20 | 22 | 30 | 60 |
| 130 | 0.5 | 5 | 6 | 7 | 35 |
| 150 | 1 | 8 | 10 | 12 | 45 |
| 100 | 1 | 5 | 5 | 10 | 30 |

From the results, it can be seen that potential irregularities are caused more frequently as the air flow rate is extremely greater or the hot wind temperature is too high, and its tendency is marked with a thermal characteristic $C/\rho$ of the substrate of higher than 0.250.

EXAMPLE 4

The drying irregularities of the charge generating layers were measured for the substrates (A) to (H) in Example 1, in which subbing layers were provided.

The subbing layers were coated and dried by use of an aqueous ammonia solution containing 10% by weight of casein to a dried film thickness of 1$\mu$. The results of measurement of the potential irregularities are shown in Table 6.

TABLE 6

| Substrate sample | (A) | (B) | (C) | (D) | (E) | (F) | (G) | (H) |
|---|---|---|---|---|---|---|---|---|
| Potential irregularity (V) | 5 | 9 | 10 | 45 | 8 | 65 | 50 | 24 |

These results show the same tendency as in Example 1.

EXAMPLE 5

In place of the charge generating layer employed in Example 1, the following solutions for charge generating layers were prepared. Dispersing was effected by means of a sand mill.

Solution (3) for charge generating layer

| | |
|---|---|
| Perylene red | 1 wt. part |
| Phenoxy resin (PKHH produced by Union Carbide Co.) | 1 wt. part |
| Methyl cellosolve | 20 wt. part |
| Xylene | 20 wt. part |

Solution (4) for charge generating layer

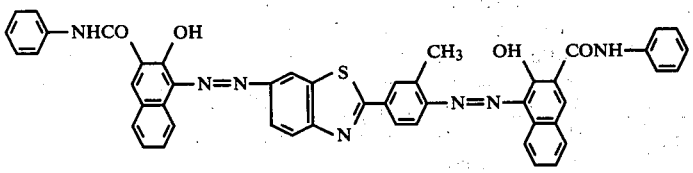

1 wt. part

| | |
|---|---|
| Polyester (Byron 103 produced by Toyo Boseki Co.) | 0.5 wt. part |
| Cyclohexanone | 50 wt. part |

Each solution was applied on the substrates (A) to (D) as shown in Table 1 and Table 2 similarly as in Example 1 to prepare functionally separated type photosensitive members. The potential irregularities in respective photosensitive members are shown in Table 7.

TABLE 7

| Substrate sample | | (A) | (B) | (C) | (D) |
|---|---|---|---|---|---|
| Potential irregularity (V) | Solution (3) | 10 | 12 | 15 | 48 |
| | Solution (4) | <5 | <5 | 11 | 34 |

It can be seen from these results that, even by use of different kinds of charge generating layers, the extent of potential irregularities are changed as the result of influences from the thermal characteristics of the substrates.

EXAMPLE 6

A coating solution for a co-crystalline complex type photosensitive layer was prepared according to the following recipe.

| | |
|---|---|
| 4-(4-dimethylaminophenyl)-2,6-diphenylthiapyrylium perchlorate | 1 wt. part |
| Polycarbonate (Panlite produced by Teijin Co.) | 30 wt. part |
| Methylene chloride | 120 wt. part |

After stirring the solution by means of a sand mill for 5 hours, a solution of 8 parts by weight or 4,4'-benzylidenebis-(N,N-diethyl-m-toluidine) dissolved in 30 parts by weight of monochlorobenzene was added thereto, followed by mixing homogeneously, to provide a coating solution. This solution was coated to a dried film thickness of 12μ on the substrates (A) to (D) of Example 1. Drying was conducted at a hot air temperature of 100° C. and a blower flow rate of 2 $m^3$/min. for 10 minutes.

The scatterings (irregularities) of potentials of the respective photosensitive members at the light portions are shown in Table 8. Charging was effected by a corona charger applied with ⊕6 kV.

TABLE 8

| Substrate sample | (A) | (B) | (C) | (D) |
|---|---|---|---|---|
| Potential irregularity (V) | 10 | 12 | 15 | 35 |

In photosensitive members employing other co-crystalline complexes comprising photoconductive polymers and the aforesaid electron transporting substances, the influences of the thermal characteristics of the substrates exhibited the same tendency as in Example 1. Also in this case, the C/ρ of substrate was found to be desirably 0.250 or less.

EXAMPLE 7

A photosensitive layer having cadmium sulfide (Cds) dispersed therein was prepared in the following manner.

| | |
|---|---|
| Photoconductive CdS pigment | 100 wt. parts |
| Styrene-ethyl methacrylate copolymer resin (experimental product; MW = 120,000) | 10 wt. parts |
| Toluene | 100 wt. parts |

The above dispersion was kneaded on a roll mill, and toluene was further added to adjust its viscosity to 500 cps. Said dispersion was coated according to the draw-up method on cylindrical substrate samples (A) to (D) as shown in Example 1 to a dried film thickness of 50μ.

Drying was carried out by means of the drier as shown in FIG. 1 under the conditions of a hot air temperature of 130° C. at an air flow rate of 1.5 $m^3$/min., and after the temperature at the inner surface of the substrate was elevated to 100° C., drying was continued for additional 20 minutes. On the surface of said CdS photosensitive layer, a polyester film of a thickness of 25μ was laminated through an intermediary urethane type adhesive layer to provide a photosensitive member.

Evaluation of each substrate was conducted according to the following steps. That is, an electrostatic latent image was formed according to the so called NP process comprising positive charging, alternate current charging simultaneous with exposure and subsequent exposure on the whole surface, and the scattering of the light portion potential was considered as the index. As apparently seen from the results shown in Table 9, the differences between the substrates were not distinct with small potential irregularities at the initial stage of evaluation. However, as the durability tests were continued, the photosensitive member prepared on a substrate (D) exceeding the C/ρ value of 0.250 sec/cm was unfavorably gradually increased in potential irregularity.

TABLE 9

| Substrate sample: | Potential irregularity (V) (A) | (B) | (C) | (D) |
|---|---|---|---|---|
| Durability test: | | | | |
| Initial stage | 5 | 7 | 10 | 10 |
| 5,000 sheets | 5 | 8 | 10 | 15 |
| 10,000 sheets | 10 | 10 | 13 | 44 |
| 20,000 sheets | 10 | 5 | 15 | 75 |

From these results, it may be considered that the thermal characteristic of the substrate have an influence on the characteristic factor of electrophotography in the drying step even in case of the CdS photosensitive member. For example, the packing state between CdS particles and the adsorption state of the binder resin, etc. seem to be partially changed.

What is claimed is:

1. An electrophotographic photosensitive member comprising a photosensitive layer formed by coating a coating solution containing a photoconductive compound on an electroconductive substrate of a metal or metal alloy followed by drying, said electroconductive substrate having a $C/\rho$ value of 0.250 or less when the heat capacity per unit surface area of said electroconductive substrate is made C cal/cm$^2$.°C. and the thermal conductivity of the material for said electroconductive substrate is made $\rho$ cal/cm.sec.°C.

2. An electrophotographic photosensitive member according to claim 1, wherein said electroconductive substrate is cylindrical.

3. An electrophotographic photosensitive member according to claim 2, wherein said electroconductive substrate has a thermal conductivity of 0.02 cal/cm.sec.°C. or more.

4. An electrophotographic photosensitive member according to claim 2, wherein said electroconductive substrate is a cylindrical aluminum, a cylindrical copper, a cylindrical stainless steel, a cylindrical chromium stainless steel or a cylindrical brass.

5. An electrophotographic photosensitive member according to claim 2, wherein said electroconductive substrate is a cylindrical aluminum.

6. An electrophotographic photosensitive member according to claim 1, wherein said photosensitive layer comprises a charge generating layer and a charge transport layer.

7. An electrophotographic photosensitive member according to claim 6, wherein said charge generating layer is a thin film having a film thickness of 0.01$\mu$ to 5$\mu$ after drying.

8. An electrophotographic photosensitive member according to claim 6, wherein said charge generating layer is a thin film having a film thickness of 0.01$\mu$ to 1$\mu$ after drying.

9. An electrophotographic photosensitive member according to claim 6, wherein said charge generating layer is a thin film having a film thickness of 0.05$\mu$ to 0.5$\mu$ after drying.

10. An electrophotographic photosensitive member according to claim 1, wherein said photosensitive layer comprises a photoconductive compound and a binder.

11. An electrophotographic photosensitive member according to claim 10, wherein said photosensitive layer comprises a coated film having a photoconductive compound dispersed in a binder.

12. An electrophotographic photosensitive member according to claim 10, wherein said photosensitive layer comprises a coated film formed by a coating solution having a photoconductive compound and a binder dissolved therein.

13. An electrophotographic photosensitive member according to claim 1, having an intermediate layer between said electroconductive substrate and the photosensitive layer,

14. An electrophotographic photosensitive member according to claim 2, wherein said electroconductive substrate is a cylindrical aluminum having an outer diameter of 80 mm or less,

15. An electrophotographic photosensitive member according to claim 1, wherein said photosensitive layer is a coated film having at least one kind of photoconductive compound selected from the group consisting of phthalocyanine pigments, disazo pigments, trisazo pigments, zinc oxide pigments, squaric acid dyes, cadmium sulfide, pyrylium dyes or co-crystalline complexes thereof and thiapyrylium dyes or co-crystalline complexes thereof.

16. An electrophotographic photosensitive member according to claim 6, wherein said charge generating layer is a coated film having at least one kind of photoconductive compound selected from the group consisting of phthalocyanine pigments, disazo pigments, trisazo pigments, zinc oxide pigments, squaric acid dyes, cadmium sulfide, pyrylium dyes or co-crystalline complexes thereof and thiopyrylium dyes or co-crystalline complexes thereof.

17. An electrophotographic photosensitive member according to claim 1, wherein said photosensitive layer is a coated film having at least one kind of photoconductive compound selected from the group consisting of pyrazolines, hydrazones, diphenylmethanes, triphenylmethanes, triphenylamines, oxadiazoles, benzooxazoles, oxazoles, thiazoles, styryls and photoconductive polymers.

18. An electrophotographic photosensitive member according to claim 6, wherein said charge transport layer is a coated film having at least one kind of photoconductive compound selected from the group consisting of pyrazolines, hydrazones, diphenylmethanes, triphenylmethanes, triphenylamines, oxadiazoles, benzooxazoles, oxazoles, thiazoles, styryls and photoconductive polymers.

19. An electrophotographic photosensitive member produced by a process comprising the steps of dipping a cylindrical electroconductive substrate of a metal or metal alloy with a $C/\rho$ value of 0.250 or less when the heat capacity per unit surface area of said cylindrical electroconductive substrate is made C cal/cm$^2$.°C. and the thermal conductivity of the material for said cylindrical electroconductive substrate is made $\rho$ cal/cm.sec.°C. into a coating solution containing a photoconductive compound, drawing up the cylindrical electroconductive substrate from said coating solution and drying the coated film formed on said cylindrical electroconductive substrate.

20. An electrophotographic photosensitive member according to claim 19, wherein the coating solution is a dispersion having a photoconductive compound together with an organic solvent in a resin.

21. An electrophotographic photosensitive member according to claim 20, wherein said coating solution contains 80% by weight or more of an organic solvent.

22. An electrophotographic photosensitive member according to claim 21, wherein said coating solution contains 90% by weight or more of an organic solvent.

23. An electrophotographic photosensitive member according to claim 22, wherein said coating solution contains 95% by weight or more of an organic solvent.

24. An electrophotographic photosensitive member according to claim 19, wherein said cylindrical electroconductive substrate is a cylindrical aluminum.

25. An electrophotographic photosensitive member produced by a process comprising the steps of dipping a cylindrical electroconductive substrate of a metal or metal alloy with a $C/\rho$ value of 0.250 or less when the heat capacity per unit surface area of said cylindrical electroconductive substrate is made C cal/cm$^2$.°C. and the thermal conductivity of the material for said cylindrical electroconductive substrate is made $\rho$ cal/cm-.sec.°C. into a coating solution for a charge generating layer containing a substance for generating charges, drawing up the cylindrical electroconductive substrate from said coating solution for the charge generating layer, drying the coated film for the charge generating layer formed on said cylindrical electroconductive substrate, dipping said cylindrical electroconductive substrate, into a coating solution for a charge transport layer containing a charge transporting substance, drawing up the cylindrical conductive substrate from said coating solution for the charge transport layer and drying the coated film for the charge transport layer formed on said cylindrical electroconductive substrate.

26. An electrophotographic photosensitive member according to claim 25, wherein the coating solution is a dispersion having a photoconductive compound together with an organic solvent in a resin.

27. An electrophotographic photosensitive member according to claim 26, wherein said coating solution for a charge generating layer contains 80% by weight or more of an organic solvent.

28. An electrophotographic photosensitive member according to claim 27, wherein said coating solution for a charge generating layer contains 90% by weight or more of an organic solvent.

29. An electrophotographic photosensitive member according to claim 28, wherein said coating solution for a charge generating layer contains 95% by weight or more of an organic solvent.

30. An electrophotographic photosensitive member according to claim 25, wherein said cylindrical electroconductive substrate is a cylindrical aluminum.

31. An electrophotographic photosensitive member produced by a process comprising the steps of dipping a cylindrical electroconductive substrate of a metal or metal alloy with a $C/\rho$ value of 0.250 or less when the heat capacity per unit surface area of said cylindrical electroconductive substrate is made C cal/cm$^2$.°C. and the thermal conductivity of the material for said cylindrical electroconductive substrate is made $\rho$ cal/cm-.sec.°C. into a coating solution for an intermediate layer, drawing up the cylindrical electroconductive substrate from said coating solution for the intermediate layer, drying the coated film for the intermediate layer, dipping said cylindrical electroconductive substrate into a coating solution for a charge generating layer containing a substance for generating charges, drawing up the cylindrical electroconductive substrate from said coating solution for the charge generating layer, drying the coated film for the charge generating layer formed on said cylindrical electroconductive substrate, dipping said cylindrical electroconductive substrate into a coating solution for a charge transport layer containing a charge transporting substance, drawing up the cylindrical electroconductive substrate from said coating solution for the charge transport layer and drying the coated film for the charge transport layer formed on said cylindrical electroconductive substrate.

32. An electrophotographic photosensitive member according to claim 31, wherein said cylindrical electroconductive substrate is a cylindrical aluminum.

33. An electrophotographic photosensitive member according to claim 32, wherein said cylindrical electroconductive substrate is a cylindrical aluminum having an outer diameter of 80 mm or less.

* * * * *

UNITED STATES PATENT AND TRADEMARK OFFICE

CERTIFICATE OF CORRECTION

PATENT NO. : 4,481,273

DATED : November 6, 1984

INVENTOR(S) : Katagiri et al.

It is certified that error appears in the above-identified patent and that said Letters Patent is hereby corrected as shown below:

Column 1, line 52, delete "aspect", insert --aspects--.

Column 2, line 51, insert --the-- between "of" and "copying".

line 53, delete ", and also the", insert --. The--.

line 62, delete "of".

line 63, after "desirably" insert --be--.

Column 3, line 11, insert "an" between "in" and "aspect".

line 12, delete "will", insert --would--.

Column 4, line 33, insert "the" between "in" and "Examples".

line 47, delete "on", insert --of--.

line 57, delete "bring about lowering in the percentage", insert --result in a lower percentage--.

Column 5, line 28, delete "from".

UNITED STATES PATENT AND TRADEMARK OFFICE

CERTIFICATE OF CORRECTION

PATENT NO. : 4,481,273

DATED : November 6, 1984

INVENTOR(S) : Katagiri et al.

It is certified that error appears in the above-identified patent and that said Letters Patent is hereby corrected as shown below:

line 66, insert "a" between "which and "schematic".

line 68, change "on", to --to--.

Column 6, line 19, insert "," between "air" and "kept".

line 20, insert "," between "temperature" and "to".

line 36, change "an", to --a--.

Column 7, line 1, change "aixs", to --axis--.

line 1, insert "the" between "of" and "abscissa".

lines 4 and 5, insert "the" between "of" and "ordinate".

line 15, insert "show" between "32'" and "the".

line 16, change "potion" to --portion--.

line 20, change "small", to --low--.

line 22, change "only with a difference of", to --with a difference of only--.

UNITED STATES PATENT AND TRADEMARK OFFICE

CERTIFICATE OF CORRECTION

PATENT NO. : 4,481,273

DATED : November 6, 1984

INVENTOR(S) : Katagiri et al.

It is certified that error appears in the above-identified patent and that said Letters Patent is hereby corrected as shown below:

line 32, change "Inhomogeneous" to --heterogenous--.

line 46, insert "a" between "have" and "delicate".

line 46, insert "the" between "on" and "formation".

line 48, change "incontinuous", to --interrupted--.

line 55, change "inhomogeneous", to --heterogeneous--.

line 66, change "Anyway, as" to --As--.

line 67, insert "the" between "in" and "case".

line 67, change "incontinuous", to --interrupted--.

Column 8, line 1, change "will", to --should--.

UNITED STATES PATENT AND TRADEMARK OFFICE

CERTIFICATE OF CORRECTION

PATENT NO. : 4,481,273

DATED : November 6, 1984

INVENTOR(S) : Katagiri et al.

It is certified that error appears in the above-identified patent and that said Letters Patent is hereby corrected as shown below:

line 3, insert --the-- between "to" and "generation".

line 5, insert --be--between "may" and "liable".

line 24, change "to create no", to --not to create a--.

line 33, change "variously different" to --various--.

line 57, change "C/p < 0.250 sec/cm; to --C/p > 0.250 sec/cm--.

Column 11, line 65, change "thiopyrylium" to --thiapyrylium--.

line 68, change "thiopyrylium" to --thiapyrylium--.

Column 16, line 37, change "tough" to --touch--.

line 57, change "charged" to --charge--.

line 64, change "for", to --far--.

UNITED STATES PATENT AND TRADEMARK OFFICE

CERTIFICATE OF CORRECTION

PATENT NO. : 4,481,273

DATED : November 6, 1984

INVENTOR(S) : Katagiri et al.

It is certified that error appears in the above-identified patent and that said Letters Patent is hereby corrected as shown below:

Column 19, line 62, after "layer", insert --:--.

line 66, after "layer", insert --:--.

Column 24, line 30, change "thiopyrylium" to --thiapyrylium--.

Signed and Sealed this

First Day of October 1985

[SEAL]

*Attest:*

*Attesting Officer*

DONALD J. QUIGG

*Commissioner of Patents and Trademarks—Designate*

UNITED STATES PATENT AND TRADEMARK OFFICE

CERTIFICATE OF CORRECTION

PATENT NO. : B1 4,481,273

DATED : July 24, 1990

INVENTOR(S) : Kazuharu Katagiri, et al.

It is certified that error appears in the above-identified patent and that said Letters Patent is hereby corrected as shown below:

Column 1 lines 19 and 20, "photosensitve" should read --photosensitive--.

Column 2 line 59, "subsrtate" should read --substrate--.

Signed and Sealed this

Third Day of September, 1991

*Attest:*

HARRY F. MANBECK, JR.

*Attesting Officer*

*Commissioner of Patents and Trademarks*

REEXAMINATION CERTIFICATE (1331st)

United States Patent [19]

Katagiri et al.

[11] B1 4,481,273

[45] Certificate Issued Jul. 24, 1990

[54] ELECTROPHOTOGRAPHIC PHOTOSENSITIVE MEMBER AND PREPARATION THEREOF

[75] Inventors: Kazuharu Katagiri; Yoshihiro Oguchi, both of Yokohama; Yoshio Takasu, Tama, all of Japan

[73] Assignee: Canon Kabushiki Kaisha, Japan

Reexamination Request:
No. 90/001,792, Jun. 20, 1989

Reexamination Certificate for:

| | |
|---|---|
| Patent No.: | **4,481,273** |
| Issued: | **Nov. 6, 1984** |
| Appl. No.: | **496,430** |
| Filed: | **May 20, 1983** |

Certificate of Correction issued Oct. 1, 1985.

[30] Foreign Application Priority Data

May 27, 1982 [JP] Japan ..... 57-90268

[51] Int. Cl.[5] ..... G03G 5/04; G03G 5/047

[52] U.S. Cl. ..... 430/59; 430/58; 430/69; 430/127; 430/132; 430/133; 430/134

[58] Field of Search ..... 430/58, 59, 69, 127, 430/132, 133, 134

[56] References Cited

U.S. PATENT DOCUMENTS

| | | | |
|---|---|---|---|
| 4,385,106 | 5/1983 | Sakai | 430/59 |
| 4,386,839 | 6/1983 | Kumagai et al. | 355/3 DR |

FOREIGN PATENT DOCUMENTS

| | | |
|---|---|---|
| 54-126036 | 9/1979 | Japan . |
| 54-128740 | 10/1979 | Japan . |
| 55-7718 | 1/1980 | Japan . |
| 55-161247 | 12/1980 | Japan . |
| 55-163543 | 12/1980 | Japan . |
| 56-106247 | 8/1981 | Japan . |
| 56-119167 | 9/1981 | Japan . |
| 56-122039 | 9/1981 | Japan . |
| 56-128952 | 10/1981 | Japan . |
| 56-135880 | 10/1981 | Japan . |
| 56-159680 | 12/1981 | Japan . |
| 57-45549 | 3/1982 | Japan . |
| 57-79981 | 5/1982 | Japan . |
| 1467184 | 3/1977 | United Kingdom . |
| 2000311 | 1/1979 | United Kingdom . |
| 2092324 | 8/1982 | United Kingdom . |

OTHER PUBLICATIONS

Coloring Material Engineering Handbook, p. 190.

*Primary Examiner*—Roland E. Martin

[57] ABSTRACT

An electrophotographic photosensitive member comprising a photosensitive layer formed by coating of a coating solution containing a photoconductive compound on a electroconductive substrate followed by drying, said electroconductive substrate having a C/ρ value of 0.250 or less when the heat capacity per unit surface area of said electroconductive substrate is made C cal/cm$^2$.°C. and the thermal conductivity of the material for said electroconductive substrate is made ρ cal/cm.sec.°C.

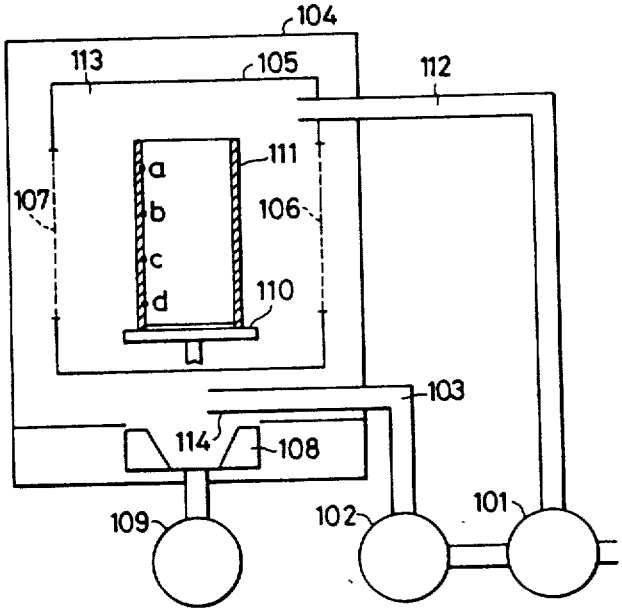

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

Claims 2, 6, 10–12, 15, 17, and 19–24 are cancelled.

Claims 1, 3–5, 7–9, 13, 14, 16, 18, 25, 26 and 31 are determined to be patentable as amended.

Claims 27–30, 32 and 33, dependent on an amended claim, are determined to be patentable.

1. [An] *A cylindrical* electrophotographic photosensitve member comprising [a photosensitive layer] *a charge generating layer having a thickness of not more than 5μ and comprising a coated film having organic pigment particles dispersed in a binder and a charge transport layer laid thereon, said charge generating layer having been* formed by [coating] *applying* a coating solution containing [a photoconductive compound on an electroconductive] *said organic pigment particles dispersed therein to a cylindrical* substrate of a metal or metal alloy [followed by drying, said electroconductive substrate] having a C/ρ value of 0.250 or less when the heat capacity per unit surface area of said [electroconductive] *cylindrical* substrate is made C cal/cm$^2$.°C. and the thermal conductivity of the material for said [electroconductive] *cylindrical* substrate is made ρ cal/cm.sec.°C. *followed by drying.*

3. An electrophotographic photosensitive member according to claim [2] *1*, wherein said [electroconductive] *cylindrical* substrate has a thermal conductivity of 0.02 cal/cm.sec.°C. or more.

4. An electrophotographic photosensitive member according to claim [2] *1*, wherein said [electroconductive] *cylindrical* substrate is [a cylindrical] *a metal selected from the group consisting of* aluminum, [a cylindrical] copper, [a cylindrical] stainless steel, [a cylindrical] chromium stainless steel [or a cylindrical] *and* brass.

5. An electrophotographic photosensitive member according to claim [2] *1*, wherein said [electroconductive] *cylindrical* substrate is [a cylindrical] aluminum.

7. An electrophotographic photosensitive member according to claim [6] *1*, wherein said charge generating layer is a thin film having a film thickness of 0.01μ to 5μ after drying.

8. An electrophotographic photosensitive member according to claim [6] *1*, wherein said charge generating layer is a thin film having a film thickness of 0.01μ to 1μ after drying.

9. An electrophotographic photosensitive member according to claim [6] *1*, wherein said charge generating layer is a thin film having a film thickness of 0.05μ to 0.5μ after drying.

13. An electrophotographic photosensitive member according to claim 1, having an intermediate layer between said [electroconductive] *cylindrical* substrate and the [photosensitive] *charge generating* layer.

14. An electrophotographic photosensitive member according to claim [2] *1*, wherein said [electroconductive] *cylindrical* substrate is a cylindrical aluminum having an outer diameter of 80 mm or less.

16. An electrophotographic photosensitive member according to claim [6] *1*, wherein said charge generating layer is a coated film having at least one kind of [photoconductive compound] *organic pigment particle* selected from the group consisting of phthalocyanine pigments, disazo pigments, *and* trisazo pigments[, zinc oxide pigments, squaric acid dyes, cadmium sulfide, pyrylium dyes or co-crystalline complexes thereof and thiopyrylium dyes or co-crystalline complexes thereof].

18. An electrophotographic photosensitive member according to claim [6] *1*, wherein said charge transport layer is a coated film having at least one kind of photoconductive compound selected from the group consisting of pyrazolines, hydrazones, diphenylmethanes, triphenylmethanes, triphenylamines, oxadiazoles, benzooxazoles, oxazoles, thiazoles, styryls and photoconductive polymers.

25. An electrophotographic photosensitive member produced by a process comprising the steps of dipping a cylindrical electroconductive substrate of a metal or metal alloy with a C/ρ value of 0.250 or less when the heat capacity per unit surface area of said cylindrical electroconductive substrate is made C cal/cm$^2$.°C. and the thermal conductivity of the material for said cylindrical electroconductive substrate is made ρ cal/cm.sec.°C. into a coating solution for a charge generating layer containing [a substance] *organic pigment particles dispersed therein* for generating charges, drawing up the cylindrical electroconductive substrate from said coating solution for the charge generating layer, drying the coated film *to a thickness of 5μ or less* for the charge generating layer *which comprises a coated film having said organic pigment particles dispersed in a binder* formed on said cylindrical electroconductive substrate, dipping said cylindrical electroconductive substrate[,] *having said dried charge generating layer* into a coating solution for a charge transport layer containing a charge transporting substance, drawing up the cylindrical conductive substrate from said coating solution for the charge transport layer and drying the coated film for the charge transport layer formed on said cylindrical electroconductive substrate.

26. An electrophotographic photosensitive member according to claim 25, wherein the coating solution *for the charge generating layer* is a dispersion having [a photoconductive compound] *organic pigment particles* together with an organic solvent in a resin.

31. An electrophotographic photosensitive member produced by a process comprising the steps of dipping a cylindrical electroconductive substrate of a metal or metal alloy with a C/ρ value of 0.250 or less when the heat capacity per unit surface area of said cylindrical electroconductive substrate is made C cal/cm$^2$.°C. and the thermal conductivity of the material for said cylindrical electroconductive subsrtate is made ρ cal/cm.sec.°C. into a coating solution for an intermediate layer, drawing up the cylindrical electroconductive substrate from said coating solution for the intermediate layer, drying the coated film for the intermediate layer, dipping said cylindrical electroconductive substrate into a coating solution for a charge generating layer containing [a substance] *organic pigment particles dispersed therein* for generating charges, drawing up the cylindrical electroconductive substrate from said coating solution for the charge generating layer, drying the coated film for the charge generating layer formed on said cylindrical electroconductive substrate *having a film thickness of 5μ or less after drying, said dried charge generating layer comprising a coated film having said organic pigment particles dispersed in a binder*, dipping said cylindrical electroconductive substrate into a coating solution for a charge transport layer containing a charge transporting substance, drawing up the cylindrical electroconductive substrate from said coating solution for the charge transport layer and drying the coated film for the charge transport layer formed on said cylindrical electroconductive substrate.

* * * * *